US005482104A

United States Patent [19]

Lichy

[11] Patent Number: 5,482,104

[45] Date of Patent: Jan. 9, 1996

[54] GUIDE SYSTEM FOR VERTICALLY MOVEABLE FLEXIBLE DOOR

[76] Inventor: Dale M. Lichy, 214 Royal Daulton Ct., Gibsonia, Pa. 15044

[21] Appl. No.: 151,384

[22] Filed: Nov. 12, 1993

Related U.S. Application Data

[63] Continuation-in-part of Ser. No. 70,949, Jun. 4, 1993.

[51] Int. Cl.[6] ..... E06B 9/17

[52] U.S. Cl. ..... 160/273.1

[58] Field of Search ..... 160/273.1, 133, 160/266, 267.1, 268.1, 269, 270, 271, 272, 11, DIG. 11

[56] References Cited

U.S. PATENT DOCUMENTS

| | | |
|---|---|---|
| 537,642 | 4/1895 | Johnston . |
| 550,412 | 11/1895 | Harris . |
| 608,436 | 8/1898 | Bowman . |
| 608,506 | 8/1898 | Bowman . |
| 618,831 | 2/1899 | Barr . |
| 626,475 | 6/1899 | Andrews . |
| 1,198,456 | 9/1916 | Knapp . |
| 1,294,879 | 2/1919 | Davis . |
| 1,387,452 | 8/1921 | Chapin . |
| 1,393,405 | 10/1921 | Soteros et al. . |
| 1,425,484 | 8/1922 | Jenkins . |
| 1,665,775 | 4/1928 | Dixson . |
| 1,673,326 | 6/1928 | Goldsmith . |
| 1,680,092 | 8/1928 | Dixson . |
| 1,726,887 | 9/1929 | Clamp . |
| 1,779,646 | 10/1930 | Traut . |
| 1,810,848 | 6/1931 | Nye . |
| 1,843,731 | 2/1932 | Petro . |

(List continued on next page.)

FOREIGN PATENT DOCUMENTS

| | | |
|---|---|---|
| 801986 | 12/1968 | Canada . |
| 978079 | 11/1975 | Canada . |
| 2260733 | 9/1975 | France . |
| 2287926 | 5/1976 | France . |
| 2313088 | 12/1976 | France . |
| 6476194 | 9/1975 | Germany . |
| 7528175 | 1/1976 | Germany . |
| 2623323 | 12/1977 | Germany . |
| 7717554 | 9/1978 | Germany . |
| 7832604 | 2/1979 | Germany . |
| 2811493 | 9/1979 | Germany . |
| 118383 | 2/1958 | New Zealand . |
| 130167 | 8/1963 | New Zealand . |
| 157764 | 2/1971 | New Zealand . |

OTHER PUBLICATIONS

Kuss Fabric Doors.
Second price list with Ormsby Catalogue attached (Aug. 1973).
Indoco Rolling Metal Doors, Cataloge No. 10–2.
"La" Planevite.
Les Portes Rapid Roll Denomafa.
Ambassador Catalogue (prior to 1982).
Balfour Rolling Doors Catalogue (prior to 1982).
Kinnear Rolling Doors & Grilles Catalogue.
REMA Tip Top Rubber flyer.
Svensk Byggkatalog (Nomafa) (1976).

*Primary Examiner*—David M. Purol
*Attorney, Agent, or Firm*—Jacobson, Price, Holman & Stern

[57] ABSTRACT

A damage minimizing closure door that is moved vertically between open and closed positions in which the door is a flexible curtain and a guide assembly is mounted on the side edges of the doorway for receiving and guiding the side edges of the flexible door during vertical movement. A counterbalancing power spring is associated with the door to assist in raising and lowering the curtain. The flexible door or curtain and the guide assembly include unique features which enable the side edges of the curtain to move vertically in the guide assembly, resist wind forces and air pressure differentials when the door is closed or moving vertically and to separate from the guide assembly upon being impacted by an externally applied force, such as by a vehicle, with little if any damage occurring to the curtain or guide assembly.

6 Claims, 6 Drawing Sheets

U.S. PATENT DOCUMENTS

| | | | |
|---|---|---|---|
| 1,892,001 | 12/1932 | Nye . | |
| 1,961,383 | 6/1934 | Nye et al. | 156/14 |
| 2,041,105 | 5/1936 | Barnhart | 156/39 |
| 2,041,258 | 5/1936 | Mitchell | 156/10 |
| 2,104,648 | 1/1938 | Hickey | 20/2 |
| 2,107,929 | 2/1938 | Benson | 20/40 |
| 2,122,532 | 7/1938 | Mims et al. | 156/10 |
| 2,250,604 | 7/1941 | Poorman et al. | 189/56 |
| 2,349,226 | 5/1944 | Thomas | 160/273 |
| 2,350,288 | 5/1944 | Michelman | 160/133 |
| 2,361,762 | 10/1944 | Glenn et al. | 160/23 |
| 2,584,014 | 1/1952 | Harper | 296/137 |
| 2,594,510 | 4/1952 | Germann | 296/98 |
| 2,621,725 | 12/1952 | Shacikoski | 160/40 |
| 2,641,031 | 6/1953 | Ehret | 20/56.4 |
| 2,783,833 | 3/1957 | Cann | 160/354 |
| 2,839,135 | 6/1958 | Anderson | 160/133 |
| 2,839,791 | 6/1958 | Lee | 20/16 |
| 2,886,103 | 5/1959 | Pitcoff | 160/269 |
| 3,149,665 | 9/1964 | Handford | 160/327 |
| 3,165,165 | 1/1965 | Chapman | 181/33 |
| 3,331,425 | 7/1967 | Groves et al. | 160/126 |
| 3,460,602 | 8/1969 | Hugus | 160/265 |
| 3,690,602 | 9/1972 | Marsh | 244/137 R |
| 3,855,733 | 12/1974 | Miller | 49/88 |
| 3,878,879 | 4/1975 | Manns | 160/273 |
| 3,960,216 | 6/1976 | Isobe | 169/48 |
| 4,126,174 | 11/1978 | Moriarty et al. | 160/266 |
| 4,175,608 | 11/1979 | Alten | 160/273 R |
| 4,273,974 | 1/1981 | Miller | 200/61.43 |
| 4,357,978 | 11/1982 | Keller et al. | 160/41 |
| 4,398,585 | 8/1983 | Marlow . | |
| 4,467,853 | 8/1984 | Downey, Jr. . | |
| 4,478,268 | 10/1984 | Palmer | 160/310 |
| 4,586,552 | 5/1986 | Labelle . | |
| 4,601,320 | 7/1986 | Taylor . | |
| 4,610,293 | 9/1986 | Weiblen | 160/120 |
| 4,649,981 | 3/1987 | Bibeau | 160/120 |
| 4,690,195 | 9/1987 | Taylor . | |
| 4,766,941 | 8/1988 | Sloop et al. | 160/241 |
| 4,825,921 | 5/1989 | Rigter | 160/23.1 |
| 5,058,651 | 10/1991 | Ashley et al. . | |
| 5,131,450 | 7/1992 | Lichy | 160/310 |
| 5,163,495 | 11/1992 | Lichy | 160/273 |
| 5,176,194 | 1/1993 | Chigusa | 160/273.1 |
| B1 4,478,268 | 4/1991 | Palmer | 160/310 |

GUIDE SYSTEM FOR VERTICALLY MOVEABLE FLEXIBLE DOOR

CROSS REFERENCE TO RELATED APPLICATIONS

This application is a continuation-in-part of U.S. patent application Ser. No. 08/070,949 filed Jun. 4, 1993 for Guide System for Vertically Moveable Flexible Door.

This application is also related to U.S. patent application Ser. No. 07/919,035 filed Jul. 24, 1992 for Closure Assembly for Structural Members now U.S. Pat. No. 5,351,742 issued Oct. 4, 1994, which is a continuation-in-part of U.S. patent application Ser. No. 07/729,696 filed Jul. 15, 1991 for Closure Assembly for Structural Members now U.S. Pat. No. 5,163,495 issued Nov. 17, 1992 which is a division of U.S. application Ser. No. 07/535,101 filed Jun. 8, 1990, now U.S. Pat. No. 5,131,450 issued Jul. 21, 1992.

BACKGROUND OF THE INVENTION

1. Field of the Invention

The present invention generally relates to a damage minimizing closure door that is moved vertically between open and closed positions in which the door is flexible and a guide assembly is mounted on the side edges of the doorway for receiving and guiding the side edges of the flexible door during vertical movement. The flexible door or curtain and the guide assembly include unique features which enable the side edges of the curtain to separate from the guide assembly upon being impacted by an externally applied force, such as by a vehicle, without damaging the curtain or guide assembly and also enabling the side edges of the curtain to be easily reinserted into the guide assembly.

2. Description of the Prior Art

Vertically disposed doors which move between open and closed positions are well known as are such doors or curtains constructed of flexible material with guide assemblies along the side edges of the opening receiving, retaining and guiding the side edges of the curtain. My U.S. Pat. Nos. 5,131,450 issued Jul. 21, 1992 and 5,163,495 issued Nov. 17, 1992 and my copending U.S. applications Ser. Nos. 08/070,949 and 07/919,035 disclose this type of door.

As indicated in the above patents and applications when a flexible door or curtain is used as a vertically movable door, it is necessary to provide a guide structure along the side edges thereof for retaining the side edges in a slot-like structure during vertical movement of the flexible door or curtain. Also, it is desirable to provide a structure which enables the side edges of the flexible curtain to separate from the guide structure in the event the flexible curtain is subjected to an excessive impact force such as a vehicle striking the door but withstand wind or air pressure without disengagement from the guide structure. However, the prior art does not disclose a structure equivalent to the unique features of the present invention which guides the side edges of the flexible curtain, enables the side edges to separate from the guide structure upon excessive impact force and enables the side edges of the curtain to be easily reinserted into the guide structures thereby avoiding damage to the flexible curtain in the event of excessive impact forces engaging the flexible curtain.

SUMMARY OF THE INVENTION

An object of the present invention is to provide a vertically opening and closing flexible door or curtain provided with a guide structure along the side edges of the door opening with cooperating structure on the side edges of the flexible curtain and on the guide structure to facilitate vertical movement of the flexible curtain, provide a single or double windlock at the side edges of the flexible curtain and enable the side edges of the flexible curtain to be disengaged from the guide structure in the event of excessive impact force on the flexible curtain and enable the side edges of the flexible curtain to be quickly and easily reinserted into the guide structure after disengagement therefrom.

Another object of the invention is to provide a guide system as defined in the preceding object in which the side edges of the flexible curtain are provided with a single or double windlock in the form of a lateral projection or projections which engage with a windbar or windbars on the guide structure in which the windbar or windbars are constructed to enable separation from the guide structure which enables the curtain to disengage from the guide structure when the curtain receives excessive impact force.

A further object of the invention is to provide a guide system for a flexible curtain which includes a guide channel having a pair of spaced, generally parallel flanges with one or both flanges including a windbar releasably mounted thereon and associated with a windlock or windlocks on the edge of the flexible curtain to enable separation of the curtain from the guide channel without damage to the curtain or the guide channel in the event of an excessive impact force coming into contact with the curtain.

Still another object of the invention is to provide a damage minimizing, low maintenance door which may include a roll up door mounted on a barrel or drum across the upper end of a doorway or in the form of a vertical lift door in which the door moves vertically completely above the upper edge of a doorway with various mechanisms being provided to facilitate movement of the door or flexible curtain between open and closed positions.

A still further object of the invention is to provide a guide system in accordance with the preceding objects in which the guide structure is provided with guides such as rollers or outwardly flared flanges forming a bell shaped guide at the top of the guide structure, weather stripping when required along each guide structure and across the top of the door opening and a bottom bar connected to the flexible curtain to provide an effective closure door for an opening with the closure door being either a roll up door or a full vertical lift door and the windlocks being one or two substantially continuous narrow strips along each side edge of the curtain.

An additional object of the invention is to provide a bottom bar which evenly distributes the weight of the bottom bar across the width of the curtain by the use of a strip attached adjacent the bottom edge of the curtain on which the bottom bar retainer sits and is retained thereby reducing the amount of bolts needed to distribute said weight.

A still further object of the invention is to provide a damage minimizing door which uses a power spring (clock type) as a counter balance to assist a motor or any other mode of operation chosen to raise the flexible curtain out of the opening.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
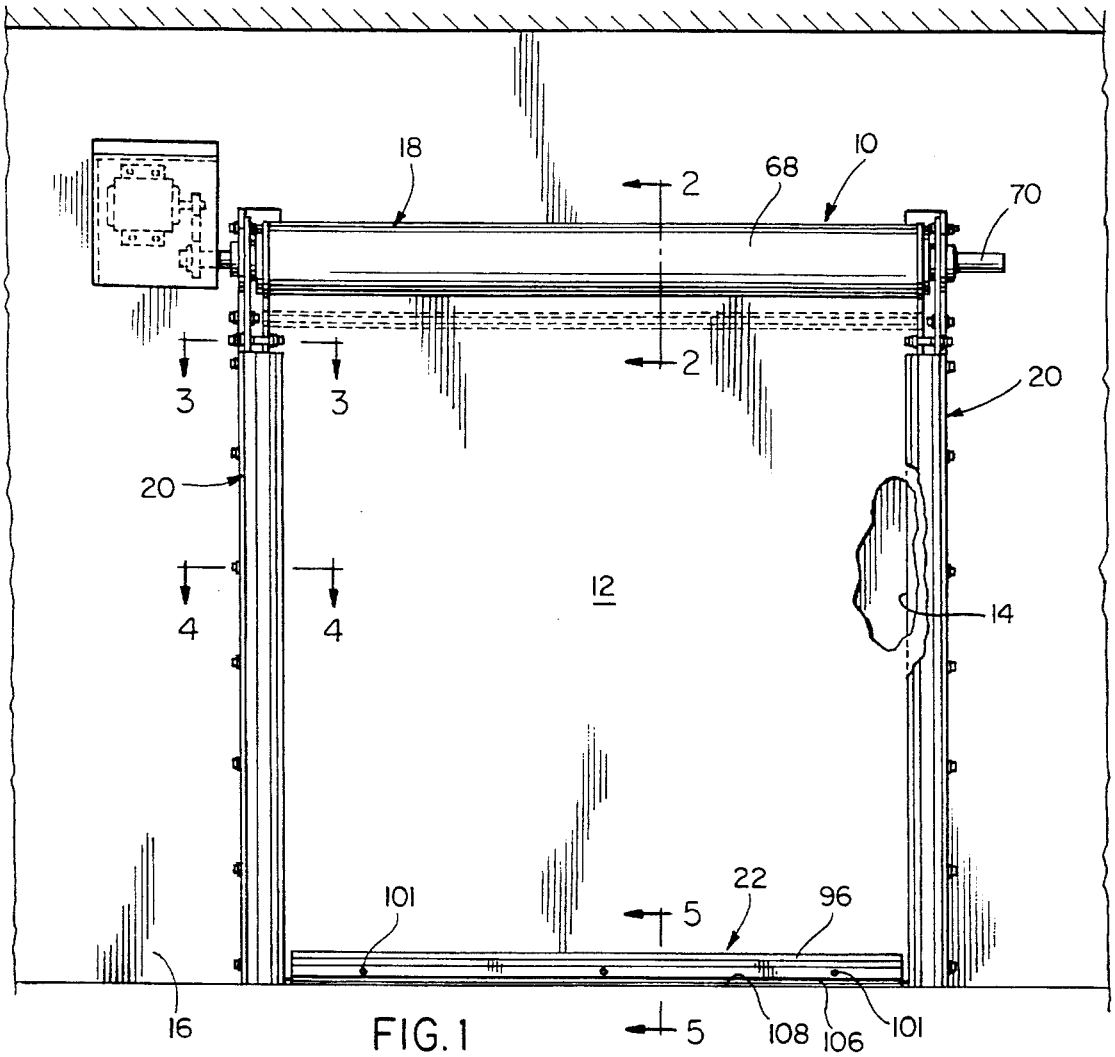
FIG. 1 is an elevational view of a roll up type vertically moving door illustrating the guide structure along each side of the flexible door or curtain.

FIGS. 1–5 disclose one embodiment of the invention generally designated by reference numeral 10 which includes a flexible door or curtain 12 having sufficient length and width characteristics to form a closure for a doorway or opening 14 in a wall 16 of a building structure. The door 10 includes a roll up drum generally designated by reference numeral 18 oriented at the top of the opening 14, a guide structure generally designated by reference numeral 20 along each side edge of the opening 14 and receiving and guiding the side edges of the curtain 12 and the bottom of the curtain 12 is provided with a bottom bar generally designated by reference numeral 22.

Figure 4:
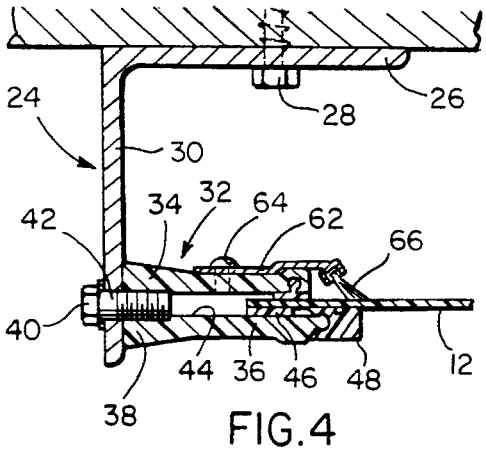
FIG. 4 is a sectional view taken along section line 4—4 on FIG. 1 illustrating the specific structure of the guide structure and edge of the curtain.

The structural details of the guide structure 20 is illustrated in FIG. 4 and includes an elongated, rigid support member 24 in the form of an angle or other structural member having a flange 26 secured to the wall 16 by any suitable fastening structures 28. The support member 24 also includes an outwardly extending flange 30 perpendicular to the flange 26 which supports a continuous inwardly facing guide member 32 with the guide member facing the doorway or opening 14 and including an inner flange 34 and an outer flange 36 generally parallel thereto with the flanges being connected at one end by a bight portion 38 that is secured to the flange 30 by a plurality of fasteners 40 in the form of bolts or the like which extend through an opening in the flange 30 and into a threaded opening 42 in the bight portion 38 of the member 32 with the flanges 34 and 36 being spaced apart to provide a groove or channel 44 which receives a side edge of the curtain 12.

As illustrated in FIG. 4, the side edge of the curtain 12 is provided with a strip 46 bonded to one surface of the side edge thereof with the strip being relatively narrow in width and also narrow in thickness with the thickness of the strip 46 being generally the same thickness as the curtain 12 although this relationship may vary. The side edge of the curtain and the strip 46 thereon serves as a windlock when associated with the guide member 32 as set forth hereinafter. The end edge of the flange 36 has an elongated retaining strip or windbar 48 mounted thereon with the windbar being constructed of plastic material and including a recess 50 in the surface thereof which faces the end edge of the flange 36 with the recess 50 being generally cylindrical in configuration but opening toward the flange 36 for snap mounting engagement with a projection or lip 52 on the end edge of the flange 36 with the lip 52 being of corresponding generally cylindrical shape for snap engagement with the recess 50 in the windbar 48. As illustrated, the windbar or strip 48 includes an inner flange portion 54 positioned interiorly of the flange 36 and projecting into the space 44 to abuttingly engage and retain the strip 46 and thus the edge of the curtain 12 within the channel shaped space 44. The construction of the windbar or strip 48 provides a low coefficient of friction with the curtain 12 and edge strip 46 and will effectively guide and retain the side edge of the curtain in the channel shaped space in the guide member 32. When the curtain 12 is in closed position and is impacted with an excessive force such as when a vehicle strikes the curtain, the lateral outward force exerted on the side edge of the curtain is resisted by the inner edge of the flange 54 on the strip 48 abutting the edge of the strip 46 until the lateral force overcomes the resilient snap mounting engagement between the recess 50 and the strip 48 and the projection 52 on the flange 36 is overcome at which time the strip 48 separates from the flange 36 and the side edge of the curtain 12 can separate from the guide member 32 with no damage or minimal damage to the curtain and guide structure.

This structure enables the side edge of the curtain 12 to be reinserted into the channel shaped space 44 and the resilient plastic strip 48 reattached to the projection 52 on the flange 36 by merely pressing the strip back into place by snapping the recess 48 onto the projection 52.

Figure 4A:
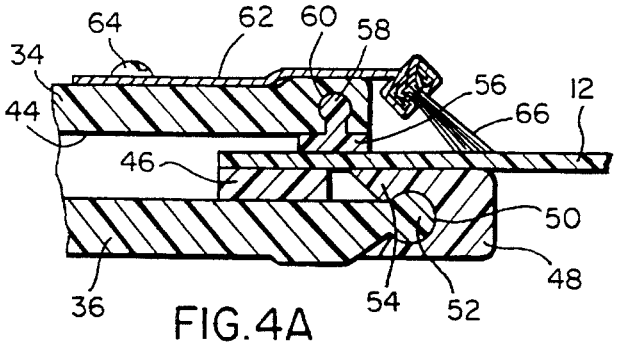
FIG. 4A is an enlarged sectional view of a portion of FIG. 4.

As illustrated in FIGS. 4 and 4A, the inner flange 34 is sometimes provided with a longitudinal spacer strip 56 which engages the surface of the curtain 12 in opposed relation to a portion of the strip 46 with the spacer strip 56 cooperating to insure engagement of the strip 46 against the windbar 48 to provide a windlock for the curtain 12 between the curtain 12 and the guide member 32. The spacer strip 56 is used when a thinner than normal curtain 12 is used to close the doorway. When a standard thickness curtain is used, the spacer strip 56 is not required. The strip 56 is replaceable by the use of a projection 58 on the surface of the strip 56 remote from the curtain 12 received in a recess 60 in the inner surface of the flange 34. The strip 56 is also constructed of plastic material while the guide member 32 is constructed of metal such as aluminum or other rigid material. The flange 34 is also provided with a weather stripping member 62 extending along the inner surface of the flange 32 and secured thereto by fastener 64 with the outer end of the weather stripping 62 including a brush member 66 engaging the surface of the curtain 12 inwardly of the guide member 32 and windbar 48 as illustrated in FIG. 4 to further provide a sealing relationship between the curtain 12 and the guide structure 20.

Figure 3:
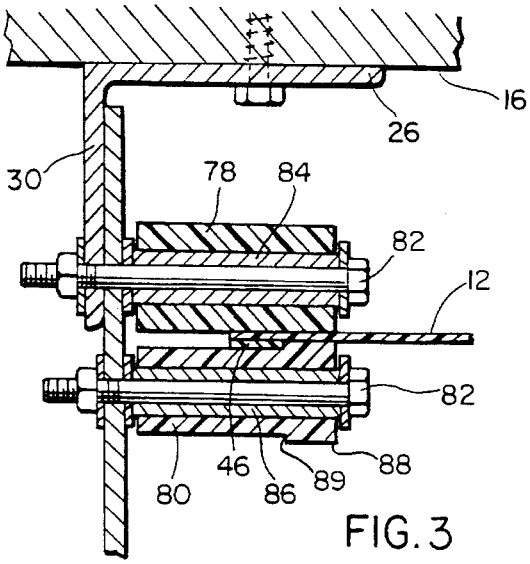
FIG. 3, is a sectional view taken along section line 3—3 on FIG. 1 illustrating guide rollers at the top edge of the guide structure.
Figure 2:
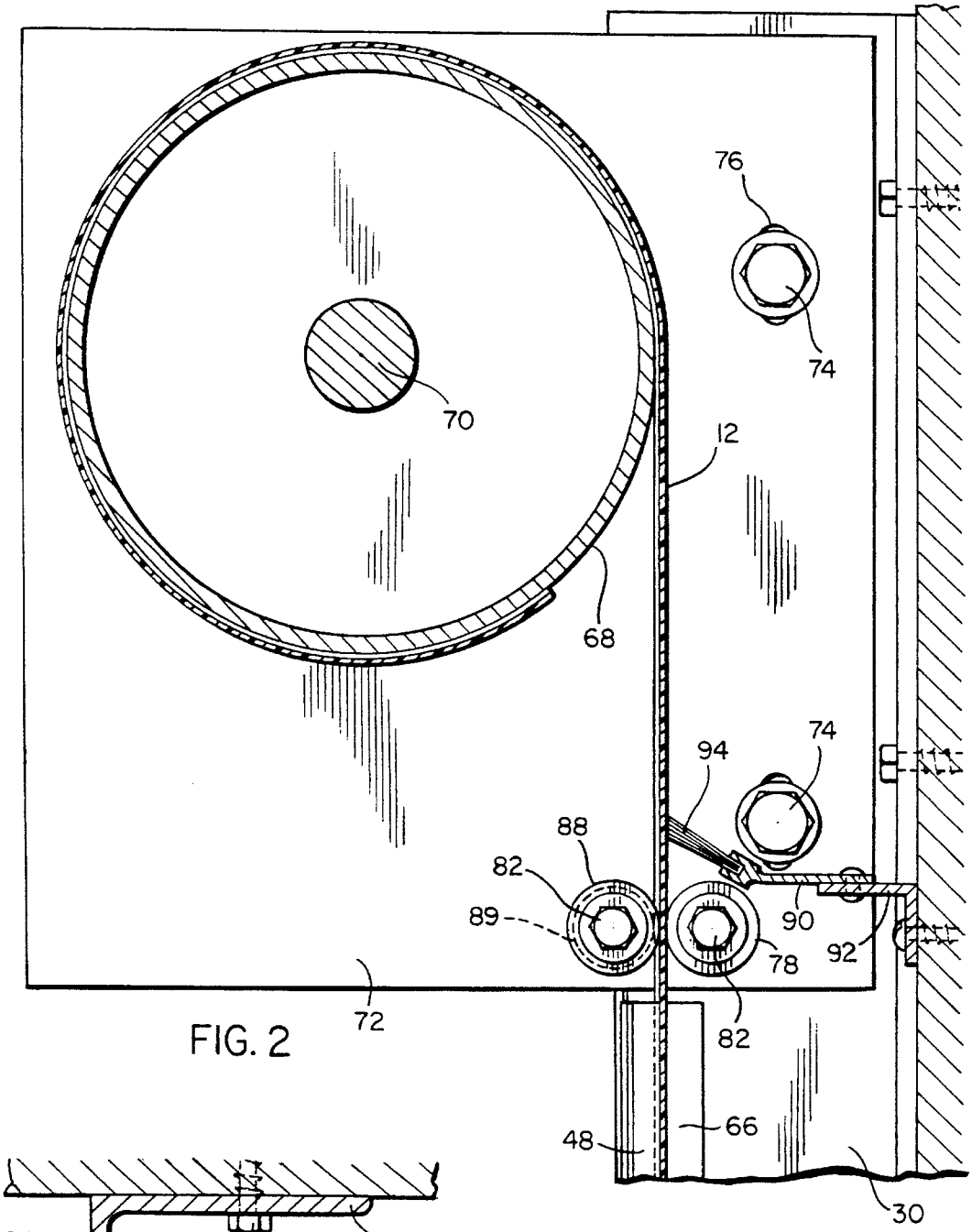
FIG. 2 is a sectional view taken substantially along section line 2—2 on FIG. 1 illustrating the specific structural details of the roller type guide at the upper end of the guide structure.

FIGS. 2 and 3 illustrate further structural details of the door 10 including a cylindrical drum 68 having one end of the curtain 12 attached thereto and wound thereon during rotation of the drum 68 which is supported by shaft structure 70 journaled in enlarged support plates 72 attached to the upper ends of flanges 30 on the support structure 24 by the use of bolt type fasteners 74 extending through slot opening 76 in the plate 72 to enable some adjustment of the position of the drum 68.

The upper end of the guide structure 20 includes a pair of guide rollers 78 and 80 spaced from each other and rotatably supported on elongated fastener bolts 82 and internal spacer sleeves 84 and 86. The roller 78 includes a cylindrical external surface and the roller 80 includes a generally cylindrical external surface but which includes a radially outwardly offset end portion 88 which receives the strip 46 on the edge of the curtain 12 with the radially offset end portion 86 defining an abutment edge 89 engaging and guiding the inner edge of the strip 46 as illustrated in FIG. 3 during movement between the rollers 78 and 80 which are idler rollers with the external surfaces thereof being generally in alignment with the channel shaped recess 44 between the flanges 34 and 36 on the guide member 32 as illustrated in FIG. 2 thus guiding movement of the curtain 12 when it is being wound onto or off of the drum 68 thus guiding the curtain in relation to the guide structure 20 and specifically guiding the strip 46 into the channel shaped space 44. A weather stripping member 90 is mounted on a bracket 92 connected to the wall 16 above the doorway opening 14 and includes a weather seal brush 94 in engagement with the surface of the curtain 12 which faces the wall 16 which, together with the weather seal brushes 66 forms a complete seal along the top and side edges of the flexible curtain when the flexible curtain is in lowered or closed position.

Figure 5:
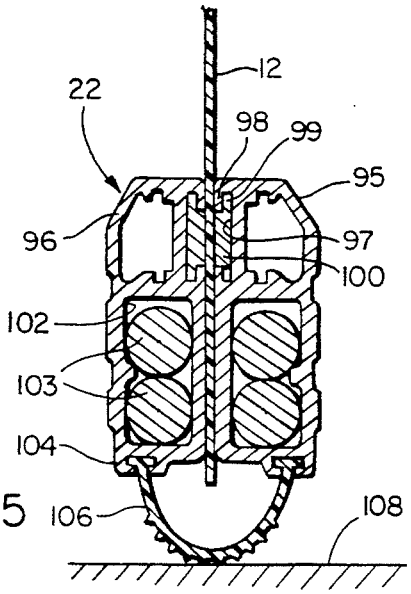
FIG. 5 is a sectional view taken along section line 5—5 on FIG. 1 illustrating the bottom bar construction connected to the bottom end of the flexible curtain.

FIG. 5 illustrates the construction of the bottom bar 22 which is a rigid structure connected to the lower end of the curtain 12 and terminates about an inch from the guide structure 20. The bottom bar 22 includes a pair of identical rigid members 95 and 96 each of which includes an indentation 97 in the inner surface. The indentation 97 includes a lip 98 which extends downwardly to engage an upturned lip 99 on a mounting strip 100. The mounting strips 100 carries and evenly distributes the weight of the bottom bar 22 across the width of the curtain 12 to keep the curtain taut and assist the downward travel of the curtain in the guide system along the side edges. The upturned lip 99 on each mounting strip 100 receives the downturned lip 98 and helps to retain the bottom bar 22 on the strips 100 which are secured to the curtain 12 such as by welding or sewing. Bolts 101 retain the bottom bar members 95, 96 on the mounting strips 100 and curtain 12 by clamping the members to the strips and curtain. The lower bottom portion of each of the members 95 and 96 is provided with a continuous cavity 102 extending therethrough capable of receiving one or more elongated weight members 103 in the form of elongated rods, cables or the like to vary the total weight of the bottom bar. The bottom edges of the members 95 and 96 have downwardly facing T-shaped grooves 104 receiving correspondingly shaped projection on a hollow, generally semicircular seal member 106 which sealingly engages the bottom surface or floor surface forming the bottom of the door opening 14 thus forming a seal for the bottom edge of the flexible curtain 12 where it engages the floor or bottom surface of the opening and the weight of the bottom bar will retain the flexible curtain 12 in a taut, straight line condition when the bottom bar 22 is spaced from the bottom surface 108 of the opening 14.

Figure 6:
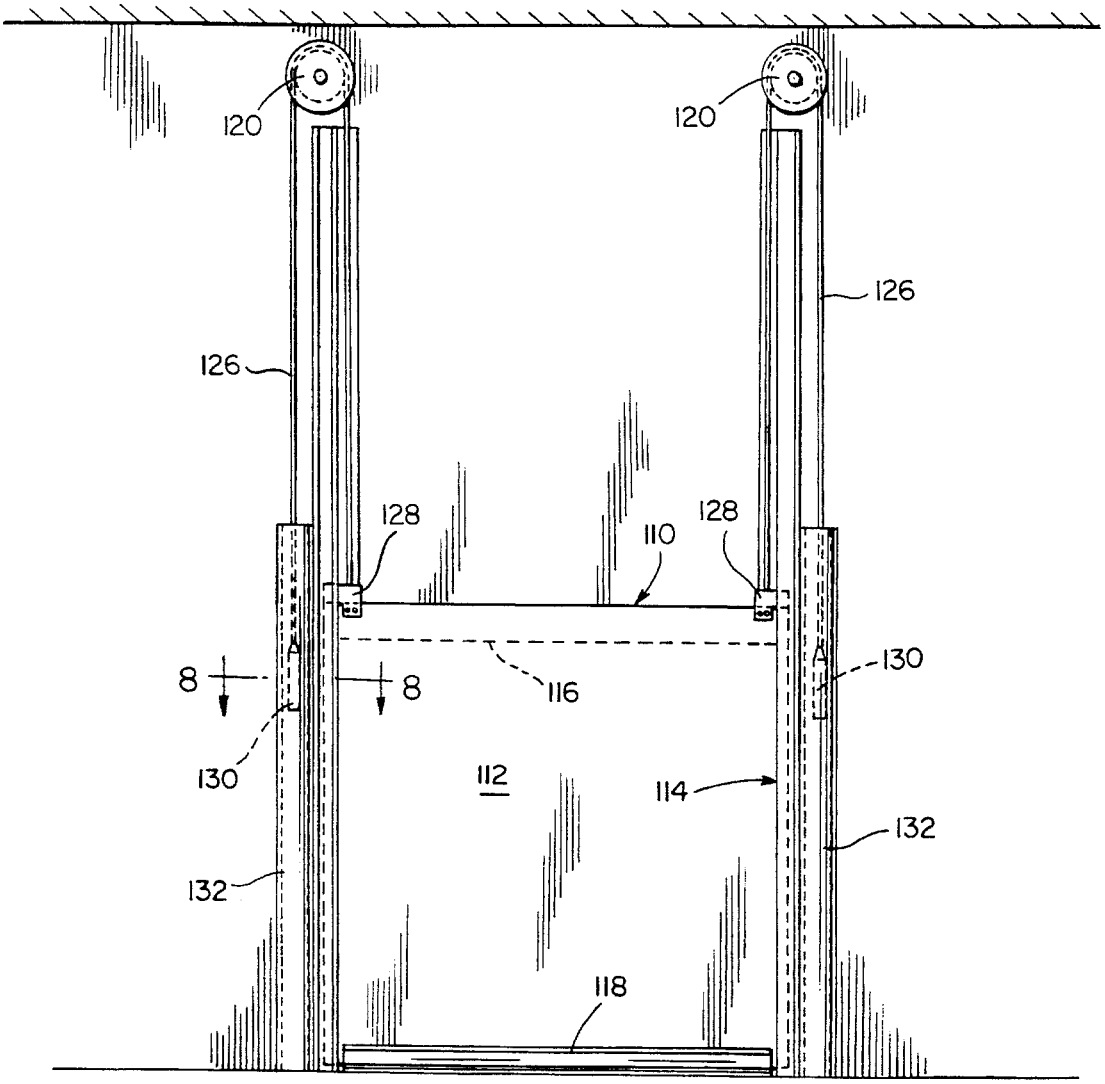
FIG. 6 is an elevational view illustrating a full lift vertical door.
Figure 7:
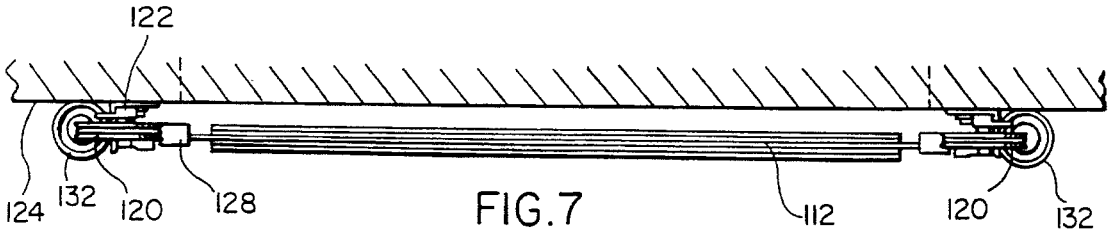
FIG. 7 is a top plan view thereof.
Figure 8:
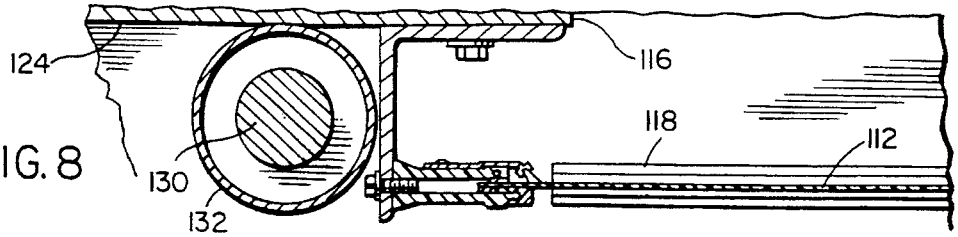
FIG. 8 is a sectional view taken along section line 8—8 on FIG. 6 illustrating the counterweight structure.

FIGS. 6–8 disclose a vertical lift door generally designated by reference numeral 110 and which includes a flexible door or curtain 112 guided by guide structures 114 which are the same in construction as the guide structures 20 in FIGS. 1–5 except that the guide structures 114 extend a vertical distance above the doorway 116 to enable the flexible curtain 112 to move vertically upwardly in a straight line condition until the bottom bar 118 is positioned in line with or above the doorway 116. The upper end of the guide structures 114 have a cable pulley or sheave 120 supported by a bracket structure 122 on the wall 124 with a cable 126 entrained over the pulley 120 with one end of the cable 126 extending downwardly along the outside of the upper portion of the guide structure 114 and being attached to a cable bracket 128 mounted on the upper edge of the flexible curtain 112. The other end of the cable 126 extends downwardly in spaced relation to the upper portion of the guide structure 114 and has a counterweight 130 attached thereto with the counterweight being vertically movably mounted in a vertically disposed guide tube 132 secured to the guide structure and wall structure in a manner to enable the counterweights 130 to balance or partially balance the weight of the flexible curtain or door to facilitate manual vertical movement of the flexible curtain 112 between open and close positions.

Figure 9:
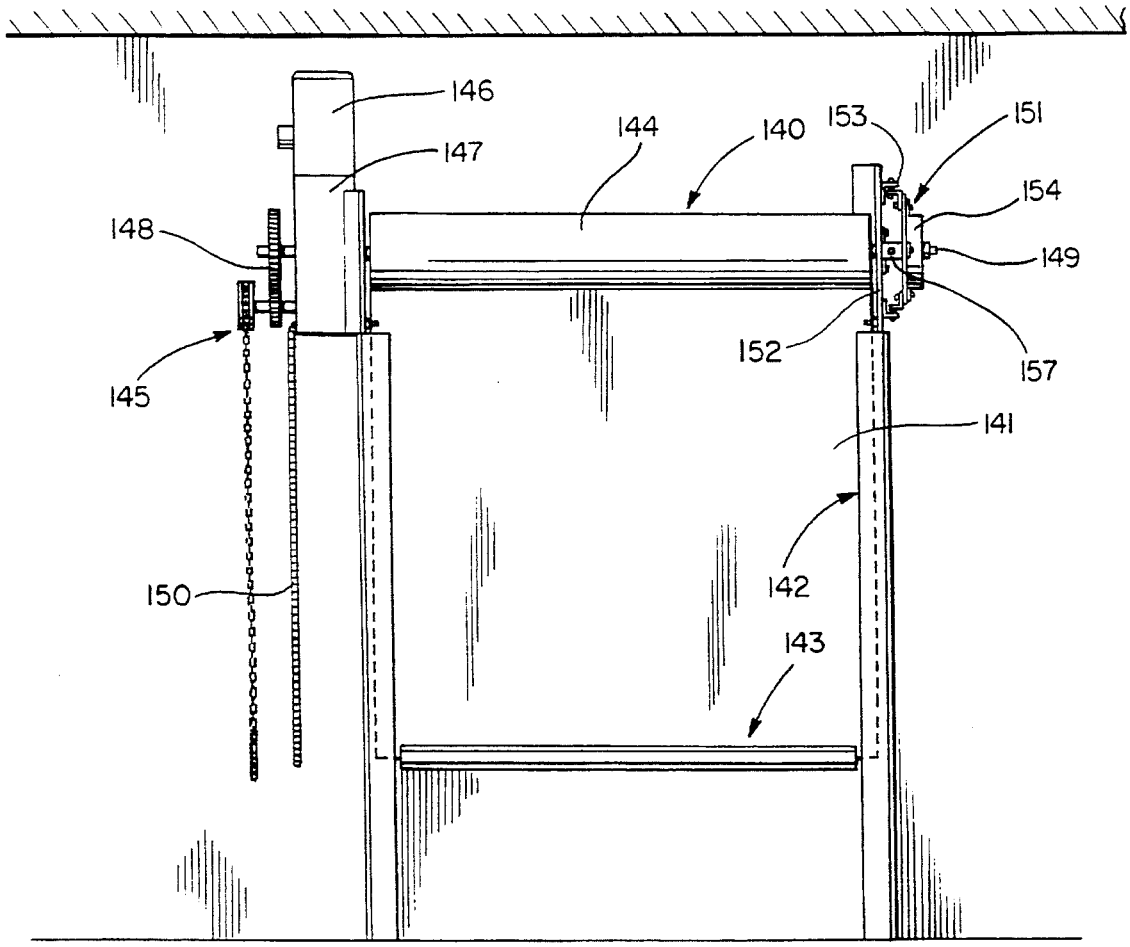
FIG. 9 is an elevational view illustrating a spiral spring assisted door which can be manually operated.
Figure 10:
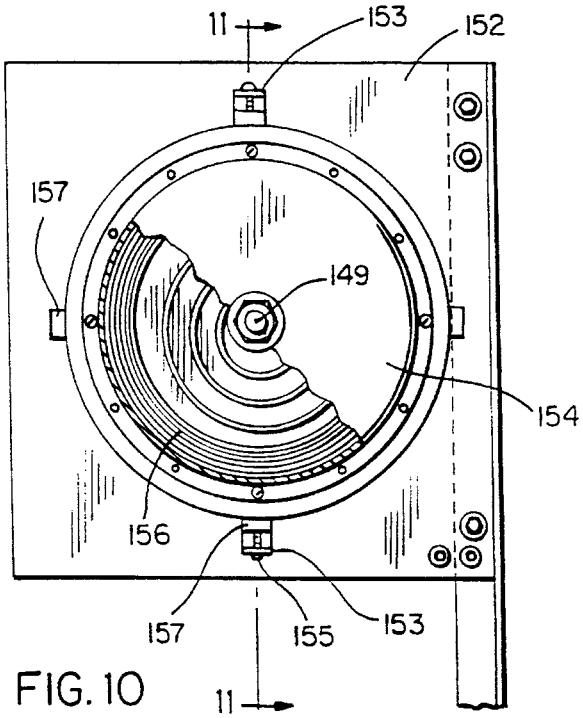
FIG. 10 is an elevational view, with portions in section, of the spring and its housing.
Figure 11:
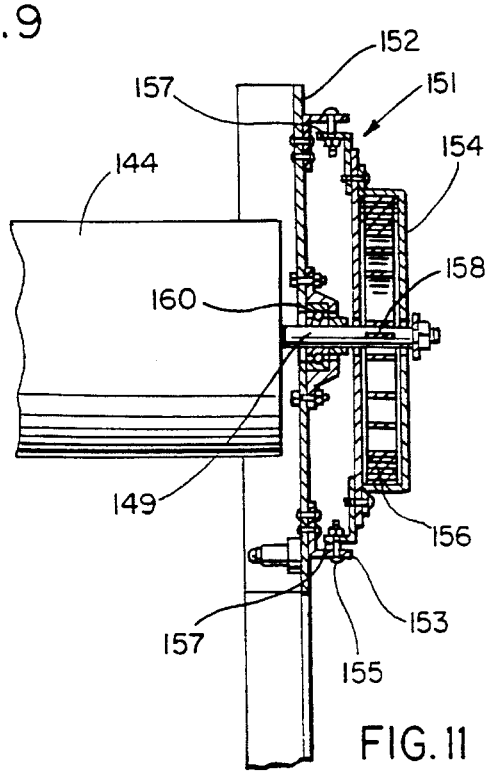
FIG. 11 is a sectional view taken along section line 11—11 on FIG. 10 illustrating details of the spring assembly.
Figure 12:
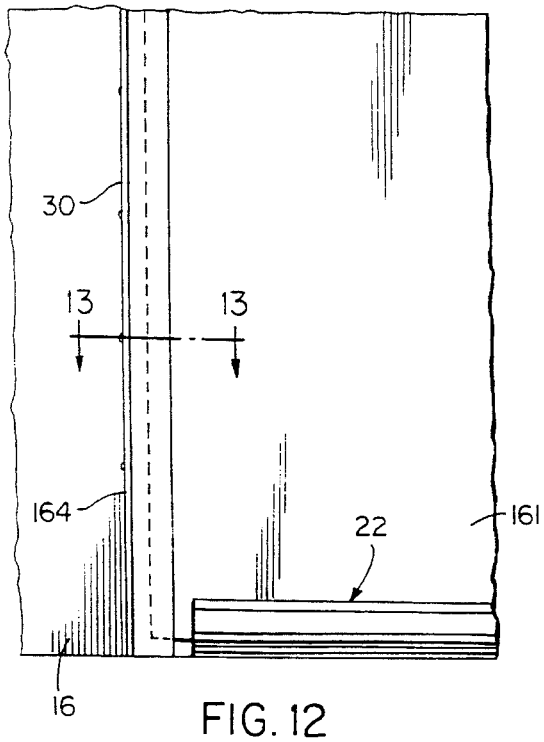
FIG. 12 is a fragmental perspective view illustrating another embodiment of the guide and curtain.

FIGS. 9–11 illustrate a manually operated roll up door 140 including a flexible curtain 141 and guide structures 142 and a bottom bar 143 which are the same as the structure illustrated in FIGS. 1–5 except that the drum or barrel 144 across the upper end of the door opening can be manually operated by a hand chain drive 145 at one end thereof or by a motor 146, gear box 147 and drive sprocket and roller chain 148 at the same end to drive shaft 149 which supports drum 144. An emergency release pull chain 150 enables the motor 146 or chain drive 145 to operate the shaft 149 and drum 144. If a hand chain operation is selected as the primary mode of operation, the motor 146, gear box 147 and chain drive 145 will be omitted. At the other end of the drum 144, a counterbalancing spring mechanism 151 which includes a spiral power spring 156 received in a housing or frame 154 with one end of the spring 156 connected to the housing or frame 154 and the other end connected to shaft 149. The spring housing 154 is supported from a mounting plate 152 attached to guide structure 142. The plate 152 includes lateral angle clips 153, preferably welded thereto, which support the hollow housing 154 by adjusting bolts 155 which interconnect the angle clips 153 on the plate 152 and angle clips 157 fastened around the outside circumference of the housing 154. A spiral power spring 156 is positioned in housing 154 with the outer end of the spring being secured to the housing 154 and the inner convolution secured to an end of the shaft 149 by a keyed casting 158. The barrel 144 and shaft 149 are supported by bearings 160 in plates 152. The spring counterbalance mechanism 151 supports and assists the manual movement of the flexible curtain 141 between open and closed positions thereby reducing the force necessary to open and close the door or curtain. The spring mechanism may be easily replaced to reduce maintenance costs and other types of springs typically used in the industry, such as a torsion spring enclosed in a barrel, can be used as a counterbalancing spring.

FIGS. 12–16 illustrate a modified guide structure 20 in which the flanges 34' and 36' flare away from each other and the bight portion of the channel shaped member 32' is omitted or separated from the flanges 34' and 36' thus enabling the flanges to be flared upwardly and outwardly to form a bell shaped upper end to the guide structure illustrated.

Figure 13:
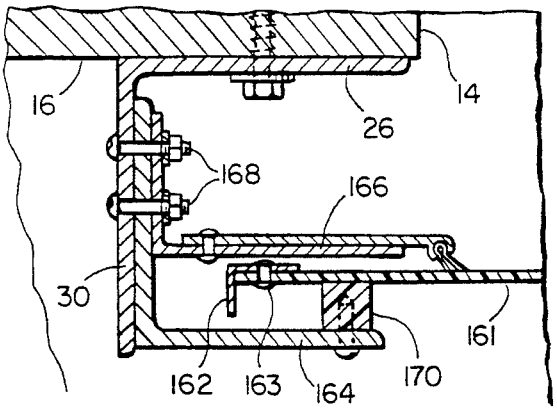
FIG. 13 is a sectional view, on an enlarged scale, illustrating structural details of FIG. 12.
Figure 14:
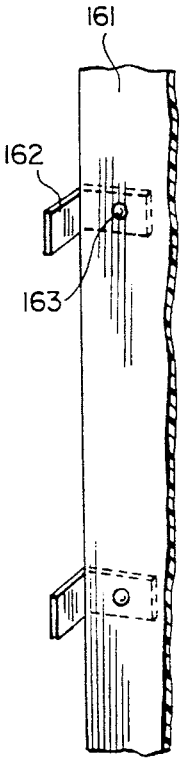
FIG. 14 is a perspective view of the segmental windlock.
Figure 15:
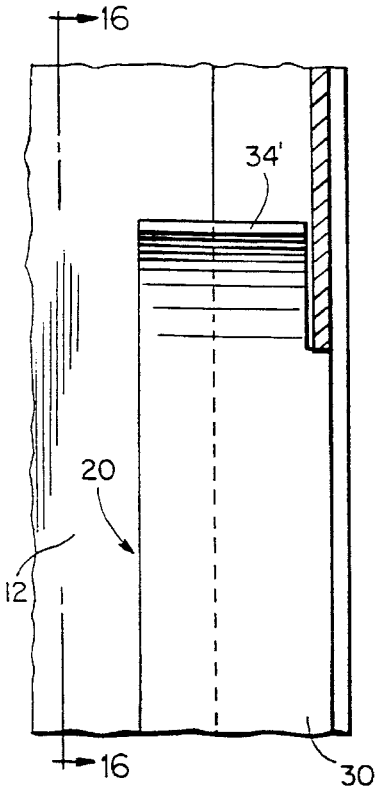
FIG. 15 is an elevational view of the upper end of the guide structure illustrating a bell shaped guide.
Figure 16:
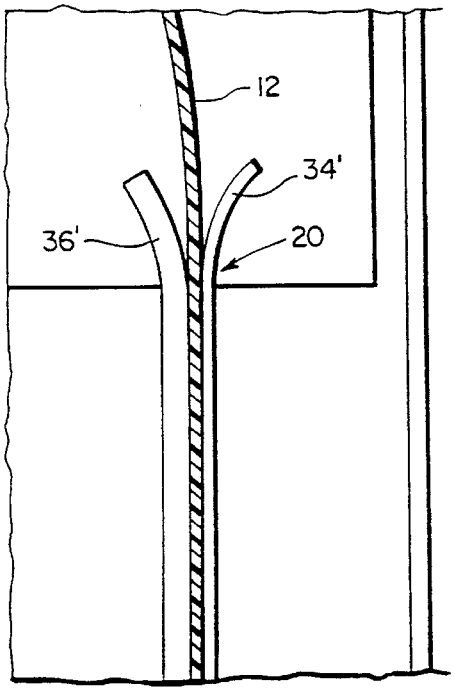
FIG. 16 is a sectional view taken along section line 16—16 on FIG. 15 illustrating additional details.

An optional structure for retaining the side edges of the door curtain in relation to the guide structure is illustrated in which the curtain is designated by reference numeral 161 having attached to the side edges thereof a segmental flexible, bendable and resilient windlock in the form of spaced angled tabs 162 attached to curtain 161 by fasteners 163 in a manner to enable the curtain to be wound onto a drum or barrel at the upper end. The guide structure includes flanges 164 and 166 defining a guide channel with the flange 166 being detachable by a bolt and nut arrangement 168. The flange 164 is provided with a stationary windbar or projection 170 which engages the curtain 161. As illustrated in FIGS. 13 and 14, the segmental tabs 162 are flexible and bendable and provided with memory or resilient characteristics sufficient to enable the tabs 162 to bend to a substantially straight condition in alignment with the curtain 161 to enable the curtain 161 to be separated from the guide structure by moving past the windbar 170. In this embodiment of the invention, the windlock formed by tabs 162 and side edge of the curtain 161 is reinserted into the guide structure by removing the nut and bolt fasteners 168.

Figure 17:
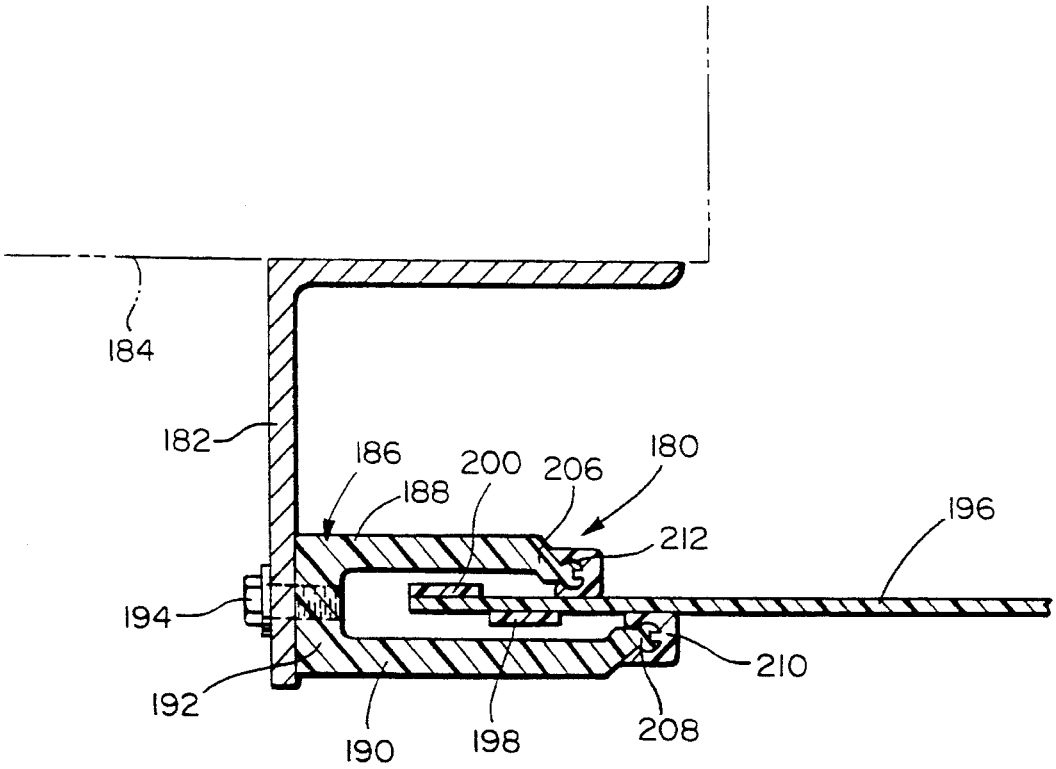
FIG. 17 is an enlarged sectional view, similar to FIG. 4A, illustrating another embodiment of the invention in which double windlocks and windbars are provided.
Figure 18:
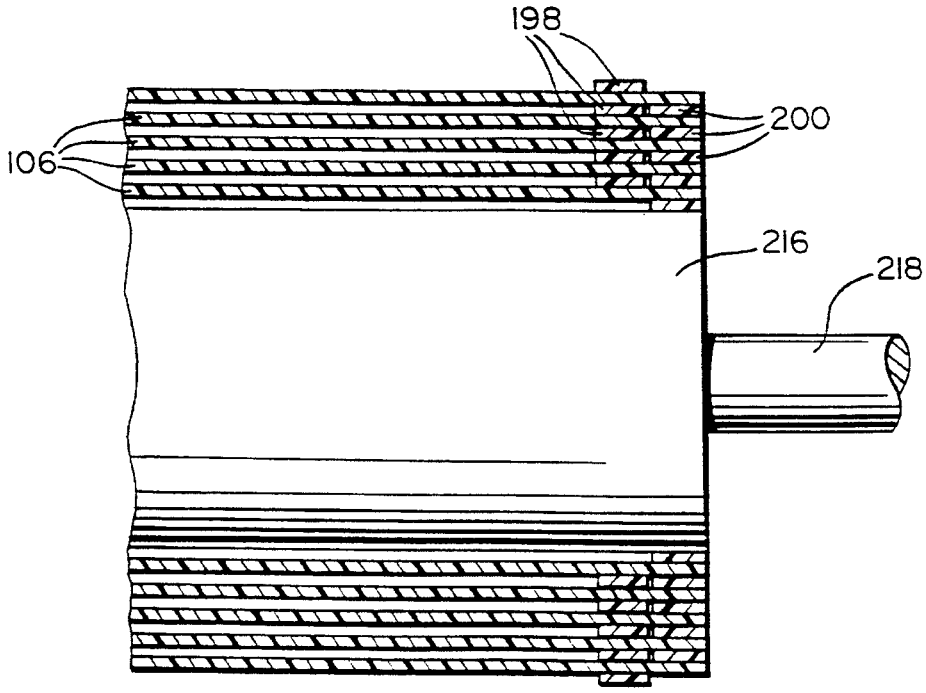
FIG. 18 is a fragmental sectional view of the structure of FIG. 17 wound onto a drum and providing an interlocking relation between the windlocks.

FIGS. 17 and 18 illustrate an embodiment of the invention which includes a guide structure generally designated by reference numeral 180 supported by a bracket structure 182 attached to a wall 184 in the same manner as the embodiment of the invention illustrated in FIG. 4. The guide structure 180 includes a guide channel 186 including spaced, generally parallel vertical flanges 188 and 190 which are interconnected at one end by a bight portion 192. The bight portion 192 is secured to the supporting bracket 182 by fastening bolts or cap screws 194. The flanges 188 and 190 may be constructed as an extrusion of metal, plastic or the like and the flanges are spaced apart to receive a flexible door or curtain 196 with the side edge of the curtain 196 received between the flanges 188 and 190.

The side edge of the curtain 196 is provided with a strip 198 on the outer surface thereof and a strip 200 on the inner surface thereof which form double windlocks. As illustrated in FIGS. 17 and 18, the strips 198 and 200 are not aligned with each other with the strip 198 on the outer surface being spaced laterally inwardly from the edge of the curtain 196 slightly greater than the width of the strip 200 which is on the inner surface of the curtain 196 and which has its outer edge generally aligned with the side edge of the curtain 196.

The outer flange 190 has a longer lateral extent as compared to the inner flange 188 with each of the flanges including an inwardly offset end portion 206 terminating in a partially cylindrical end edge 208 for snap engagement with a windbar 210 in the form of a generally channel shaped member having an internal recess 212 for snap engagement with the edge 208 of the channels 188 and 190. As illustrated, the inner edge of each of the windbars projects inwardly from the flanges 188 and 190 and engage opposite surfaces of the curtain 196 in slightly staggered relation. Thus, the inner edge of the inner flange of each of the windbars is in the path of movement of the windlocks 198 and 200 when the edge of the curtain 196 is moved out of the guide channel with the snap engagement of the windbars 210 enabling the windbars 210 to be pulled off of the flanges 188 and 190 when the curtain is subjected to an excessive force such as an impact from a vehicle or the like. This structure operates in a manner similar to that illustrated in FIGS. 4 and 4A except that a double windlock is provided on the curtain 196 by the strips 198 and 200 and a double windbar is provided on the guide channel 186 by the windbars 210. As illustrated in FIG. 17, the partially cylindrical end edge 208 and the windbars 210 have a positioning projection and recess to orient the windbars in proper position which is also provided by the outer flange of the windbars including an inclined edge which engages the inclined surface of the offset portion 206 of the flanges. The staggered relation of the windbars enables sequential separation of the windbars from the flanges as the curtain moves outwardly from the flanges.

FIG. 18 illustrates the curtain wound on a drum 216 supported by a shaft 218 in which the stagger relationship of the windlocks or strips 198 and 200 provide an interlocking effect on the end portion of the convolutions of the curtain 196 when it is wound onto the drum thus maintaining the end edges of the convolutions of the curtain 196 in radial alignment when being wound on or unwound from the drum. This interlocking effect provides for proper orientation of the curtain as it is wound onto the drum or unwound from the drum with the relationship of the windlocks and flanges of the guide channel maintaining proper position of the side edges of the curtain during vertical movement with the windbars maintaining the windlocks within the guide channels to resist the forces of wind or air pressure differentials without separating the windbars. When the curtain is impacted such as by a vehicle or the like by an excessive force, the windlock strips 198 and 200 will pull the windbars 210 off of the edges of the flanges 188 and 190 thereby releasing the curtain before damage occurs. This also enables the curtain to be reassembled by inserting the side edge between the flanges 188 and 190 and reinstalling the windbars by snapping engagement with the partially cylindrical edges 208 of the flanges.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. In a vertically movable closure door including a flexible curtain movable vertically between a closed position in occluding relation to a door opening and an open position out of registry with the door opening, a guide structure along side edges of a door opening for guiding movement of the flexible curtain, the improvement comprising each guide structure including a guide channel opening toward the door opening, said guide channel being defined by spaced, generally parallel flanges, coacting means adjacent the side edge of the curtain and the flanges of the guide channel to releasably retain the side edge of the curtain within the guide channel, to guide the vertical movement of the curtain, and to release the curtain from the guide channel upon engagement of a sufficient impact force on said curtain, said coacting means including laterally extending, outwardly and inwardly facing projections adjacent the side edge of the curtain on opposite surfaces thereof and laterally extending inwardly facing projections on each of said flanges with the projections on the flanges and curtain normally facing each other during vertical movement of the curtain said projections on said flanges of the guide channel being releasably secured to said flanges to retain the side edge of the curtain within the guide channel during vertical movement and enabling the projections on said flanges to be displaced by separation from the flanges of the guide channel upon an excessive impact force engaging the curtain, thereby enabling the side edge of the curtain to separate from the guide channel.

2. The door as defined in claim 1 wherein the projections on the curtain are substantially continuous strips, the strip on the outer surface being offset in relation to the strip on the inner surface of the curtain, said projections on the flanges being windbars engageable with the inner and outer surfaces of the curtains, said strips engaging said windbars in sequential relation due to the offset of the strips.

3. A low maintenance door comprising:

a vertically movable flexible curtain including a top, bottom and side edges, said side edges including a thicker area along a substantial length thereof, each thicker area including a substantially continuous strip along the inner surface of the curtain and a substantially continuous strip along the outer surface of the curtain, said strips forming a double windlock, a rotatable barrel located above a door opening with said flexible curtain affixed thereto with the rotation of said barrel causing the flexible curtain to raise and lower into and out of the door opening, a guide system along each side of the door opening including inner and outer windbars to restrain said side edges of the curtain from escapement from the guide system under normal wind load or pressure condition, means separably mounting said windbars on the guide system to releasably retain the double windlocks in the guide system, said double windlocks on the side edges of the flexible curtain engaging with said windbars when an excessive impact such as a vehicle, is put upon the flexible curtain which causes release of said windbars thereby releasing said side edges of the curtain from the guide system thereby causing little if any damage to said flexible curtain or guide system.

4. The door as defined in claim 3 wherein said strips on the inner and outer surfaces of the curtain are offset for interlocking association when the curtain is spirally wound on said barrel.

5. A low maintenance door comprising:

a vertically movable flexible curtain including a top, bottom and side edges, said side edges including a thicker area along a substantial length thereof, each thicker area including a substantially continuous strip along the inner surface of the curtain and a substantially continuous strip along the outer surface of the curtain, said strips forming a double windlock, said vertical flexible curtain moving in a guide system substantially vertically straight during vertical movement to and from a position above a door opening, said guide system extending above the door opening for guiding the flexible curtain, and means moving the flexible curtain vertically to move the entire flexible curtain to a position above an upper edge of the door opening, said guide system along each side of the door opening including inner and outer windbars to restrain said side edges of the curtain from escapement from the guide system under normal wind load or pressure condition, means separably mounting said windbars on the guide system to releasably retain the double windlocks in the guide system, said double windlocks on the side edges of the flexible curtain engaging with said windbars when an excessive impact such as a vehicle, is put upon the flexible curtain which causes release of said windbars thereby releasing said side edges of the curtain from the guide system thereby causing little if any damage to said flexible curtain or guide system.

6. A low maintenance door comprising:

a vertically movable flexible curtain including a top, bottom and side edges, said side edges including a thicker area along a substantial length thereof, each thicker area including a substantially continuous strip along the inner surface of the curtain and a substantially continuous strip along the outer surface of the curtain, said strips forming a double windlock, means for raising and lowering the flexible curtain into and out of the door opening, a guide system along each side of the door opening including inner and outer windbars to restrain said side edges of the curtain from escapement from the guide system under normal wind load or pressure condition, means separably mounting said windbars on the guide system to releasably retain the double windlocks in the guide system, said double windlocks on the side edges of the flexible curtain engaging with said windbars when an excessive impact such as a vehicle, is put upon the flexible curtain which causes release of said windbars thereby releasing said edges of the curtain from the guide system thereby causing little if any damage to said flexible curtain or guide system.

* * * * *